US011387038B2

(12) United States Patent
Weinberg et al.

(10) Patent No.: US 11,387,038 B2
(45) Date of Patent: Jul. 12, 2022

(54) POLYAMIDE ELECTRICAL INSULATION FOR USE IN LIQUID FILLED TRANSFORMERS

(71) Applicants: Martin Weinberg, New Canaan, CT (US); Askim Senyurt, Beaverton, OR (US)

(72) Inventors: Martin Weinberg, New Canaan, CT (US); Askim Senyurt, Beaverton, OR (US)

( * ) Notice: Subject to any disclaimer, the term of this patent is extended or adjusted under 35 U.S.C. 154(b) by 0 days.

(21) Appl. No.: 16/797,901

(22) Filed: Feb. 21, 2020

(65) Prior Publication Data

US 2020/0335267 A1 Oct. 22, 2020

Related U.S. Application Data

(60) Continuation of application No. 15/892,957, filed on Feb. 9, 2018, now abandoned, which is a division of application No. 15/406,067, filed on Jan. 13, 2017, now Pat. No. 9,892,845.

(60) Provisional application No. 62/278,226, filed on Jan. 13, 2016.

(51) Int. Cl.

| | |
|---|---|
| ***H01F 27/10*** | (2006.01) |
| ***H01F 27/32*** | (2006.01) |
| ***H01F 41/12*** | (2006.01) |
| ***H01B 3/30*** | (2006.01) |
| ***H01F 27/02*** | (2006.01) |
| ***H01F 41/00*** | (2006.01) |
| *H01F 27/12* | (2006.01) |

(52) U.S. Cl.

CPC ..... *H01F 27/32* (2013.01); *H01B 3/305* (2013.01); *H01F 27/02* (2013.01); *H01F 27/323* (2013.01); *H01F 27/324* (2013.01); *H01F 41/00* (2013.01); *H01F 41/125* (2013.01); *H01F 27/12* (2013.01)

(58) Field of Classification Search

CPC ..... H01F 27/12; H01F 27/32

USPC ..... 336/57, 58

See application file for complete search history.

(56) References Cited

U.S. PATENT DOCUMENTS

| | | | | |
|---|---|---|---|---|
| 2009/0261934 | A1* | 10/2009 | Wolfgram | H01F 38/02 336/182 |
| 2011/0224346 | A1* | 9/2011 | Eibeck | C08K 13/04 524/413 |
| 2013/0225769 | A1* | 8/2013 | Rome | C08L 77/06 525/426 |
| 2014/0022039 | A1* | 1/2014 | Weinberg | H01F 27/12 336/94 |
| 2016/0271920 | A1* | 9/2016 | Franosch | C08L 77/02 |
| 2017/0178765 | A1* | 6/2017 | Ikeda | C08G 73/14 |

* cited by examiner

*Primary Examiner* — Ronald Hinson

(74) *Attorney, Agent, or Firm* — Getz Balich LLC

(57) ABSTRACT

A transformer assembly and a method of producing the same are provided. The transformer assembly includes a housing, transformer oil, and a plurality of coils of electrically conductive wire. The transformer oil is disposed within the housing. The coils of electrically conductive wire are disposed in the housing and in contact with the transformer oil. A cross-linked aliphatic polyamide insulation material configured to electrically insulate the electrically conductive wire. The insulation material includes stabilizing compounds that provide thermal and chemical stability for the insulation material.

6 Claims, 4 Drawing Sheets

POLYAMIDE ELECTRICAL INSULATION FOR USE IN LIQUID FILLED TRANSFORMERS

This application is a continuation of U.S. patent application Ser. No. 15/892,957 filed Feb. 9, 2018, which is a divisional of U.S. patent application Ser. No. 15/406,067 filed Jan. 13, 2017, which claims priority to U.S. Patent Appln. No. 62/278,226 filed Jan. 13, 2016, which are hereby incorporated by reference.

BACKGROUND OF THE INVENTION

1. Technical Field

This invention relates to insulation and electrical components that utilize electrical insulation for use in a liquid environment in general, and to electrical transformers and components thereof that utilize electrical insulation in an oil environment in particular.

2. Background Information

Current standard insulating materials in liquid filled transformers are cellulosic materials of various thicknesses and density. Cellulose-based insulating materials, commonly called Kraft papers, have been widely used in oil-filled electrical distribution equipment since the early 1900's. Despite some of the shortcomings of cellulose, Kraft paper continues to be the insulation of choice in virtually all oil-filled transformers because of its low cost and reasonable performance. It is well known, however, that cellulosic insulation in an oil environment is subject to thermal degradation and vulnerable to oxidative and hydrolytic attack.

U.S. Pat. No. 8,193,896 and U.S. Patent Publication No. 2014/0022039 describe heat stabilized aliphatic polyamide materials that can be used as an electrical insulation within liquid filled electrical transformers. Testing of the heat stabilized aliphatic polyamide materials described in these documents has established that they perform very well when used in a cellulose-free application; e.g., when 100% of the insulating materials within an electrical transformer are formed from the aforesaid heat stabilized aliphatic polyamide materials.

SUMMARY OF THE INVENTION

In certain electrical transformer applications, it may be desirable to utilize both heat stabilized aliphatic polyamide materials as an insulating material and other insulating materials that include some amount of cellulose. To satisfy such applications and create an insulating material with enhanced performance and durability characteristics, we conducted tests wherein one or more heat-stabilized aliphatic polyamide films (e.g., like those described above) were exposed to a mixture of transformer oil and electrical grade Kraft paper to a high temperature environment for an extended period of time (e.g., a test period of at least 100 hours). The main constituent of Kraft paper is cellulose (about 90%), and the remaining constituents typically include about 6-7% lignin, 3-4% hemicelluloses (typically pentosans) and traces of metallic cations. Kraft paper also typically includes some amount of adsorbed water; e.g., 2-4% water/paper weight ratio. Degradation of the paper in transformer oil is strongly influenced by scission and shortening of the cellulose chains. Hydrolytic aging of Kraft paper produces acids; e.g., low molecular acids like formic acid, acetic acid, laevulinic acid, etc. Simultaneously naphtenic acid and stearic acid will be formed along with low molecular weight acids in the oxidation of insulating oils.

Certain of the above-described tests were conducted using "Nylon 66", which is a particular type of aliphatic polyamide material. The testing description/results provided below are described in terms of the Nylon 66 example. The description/results provided below is not limited to Nylon 66, however, and is equally applicable to other aliphatic polyamide materials.

Nylon 66 linear polymers contain amine and carboxyl chain end groups that are available for further reaction with acid and base groups. Nylon 66 exists in equilibrium with its acid and amine chain end group at each molecular weight. The molecular weight of Nylon 66 can be controlled by the addition of acetic acid during polymerization reaction, which terminates the further reaction of amine chain ends. Stearic acid type additives are also used to control the viscosity stability of Nylon 66 during compounding or extrusion steps. Nylon 66 is highly stable against the hydrocarbon solvents such as transformer oils, however it can be easily solubilized by the presence of formic acid. As a matter of fact, ISO Method 307 clearly takes advantage of the solubility of Nylon 66 in 90% formic acid at room temperature to determine the viscosity/molecular weight of Nylon 66.

Accelerated aging test studies of Nylon 66 and Kraft paper in transformer oil were carried out in the airtight bottles in heating ovens at a variety of temperatures (e.g., 70° C., 90° C., 110° C. and 130° C.). These test studies established that low molecular weight acids can be extracted from both the transformer oil and the Kraft paper. The existence of one or more low molecular acids (e.g., acetic acid, stearic acid, formic acid, etc.) in transformer insulation subjected to a high temperatures (e.g., in the range of about 100-150° C.) can accelerate the degradation of a aliphatic polyamide material such as Nylon 66; e.g., via reaction of amine chain ends with one or more low molecular acids, which reaction can reduce the molecular weight of Nylon 66.

Under certain circumstances, reactions of the type described above can compromise the mechanical strength of an aliphatic polyamide film; e.g., by one or more low molecular acids attacking and reducing the molecular weight of the film to a point where the aliphatic polyamide film begins to solubilize into the transformer oil and thereby loses its integrity as a film.

According to an aspect of the present invention, a transformer assembly is provided. The transformer assembly includes a housing, transformer oil, and a plurality of coils of electrically conductive wire. The transformer oil is disposed within the housing. The coils of electrically conductive wire are disposed in the housing and in contact with the transformer oil. A cross-linked aliphatic polyamide insulation material configured to electrically insulate the electrically conductive wire. The insulation material includes stabilizing compounds that provide thermal and chemical stability for the insulation material.

According to another aspect of the present disclosure, a transformer assembly is provided. The transformer assembly includes a housing, transformer oil, a first element, a second element, and a cross-linked aliphatic polyamide electrical insulation material. The transformer oil is disposed within the housing. The first element is configured to be at a first electrical potential during operation of the transformer assembly. The second element is configured to be at a second electrical potential during operation of the transformer assembly, which second electrical potential is different than the first electrical potential. The cross-linked aliphatic polyamide electrical insulation material includes one or more stabilizing compounds that provide thermal stability, or chemical stability, or both thermal and chemical stability for the insulation material. The insulation material is disposed within the housing between the first element and the second element, and in contact with the transformer oil. The insulation material is configured to provide sufficient electrical insulation between the first element and the second element to prevent electrical communication between the first element and second element during operation of the transformer assembly.

According to another aspect of the present disclosure, a method of electrically insulating elements within an electrical transformer assembly is provided, which electrical transformer assembly includes transformer oil disposed within a housing. The method includes: a) providing a cross-linked aliphatic polyamide electrical insulation material that includes at least one cross-linker comprising a carboxylic anhydride group and ethynyl moieties, and one or more stabilizing compounds that provide thermal stability, or chemical stability, or both thermal and chemical stability, for the insulation material; and b) positioning the electrical insulation material in the transformer oil between a first element and a second element, which first element is configured to be at a first electrical potential during operation of the transformer assembly, and which second element is configured to be at a second electrical potential during the operation of the transformer assembly, and wherein the second electrical potential is different than the first electrical potential.

In any of the aspects described herein, the insulation material may consist essentially of an aliphatic polyamide that includes at least one cross-linker comprising a carboxylic anhydride group and ethynyl moieties, and the one or more stabilizing compounds.

In any of the aspects and embodiments described herein, the at least one cross-linker may be in the range of about 0.1% to about 10.0% by weight of the insulation material.

In any of the aspects and embodiments described herein, the aliphatic polyamide insulation material may contain at least about 65 amino end groups (i.e., 65 mmol/kg)

In any of the aspects and embodiments described herein, the one or more stabilizing compounds may be present in the insulation material in a range of about 0.1% to 10.0% by weight, and the insulation material may comprise at least one cross-linker in the range of about 0.1% to 10.0% by weight, and the remainder of the insulation material may consist essentially of an aliphatic polyamide.

In any of the aspects and embodiments described herein, the aliphatic polyamide insulation may have a copper (Cu) concentration of at least 150 ppm.

In any of the aspects and embodiments described herein, the one or more stabilizing compounds may include one or more copper compounds and one or more salts including a halogenide acid group.

In any of the aspects and embodiments described herein, at least one of the copper compounds may include one or more complex ligands.

In any of the aspects and embodiments described herein, the aliphatic polyamide insulation material may have a percentage of crystallinity of at least about 45%.

In any of the aspects and embodiments described herein, the insulation material may include at least one nano-filler in the range of about 0.1% to 10.0% by weight.

In any of the aspects and embodiments described herein, the insulation material may include a chain extender.

The present disclosure will become more readily apparent in view of the detailed description provided below, including the accompanying drawings.

The present invention will be more readily understood from the following detailed description of preferred embodiments thereof.

DETAILED DESCRIPTION

Figure 1:
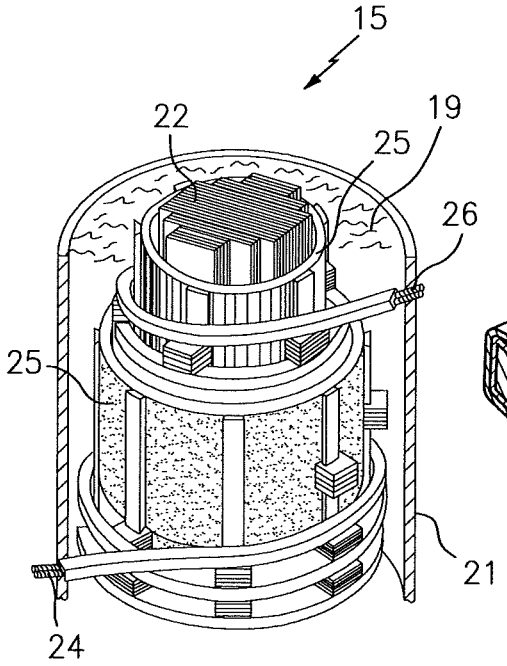
FIG. 1 is a fragmented diagrammatic perspective view of a transformer which is formed in accordance with this invention.
Figure 2:
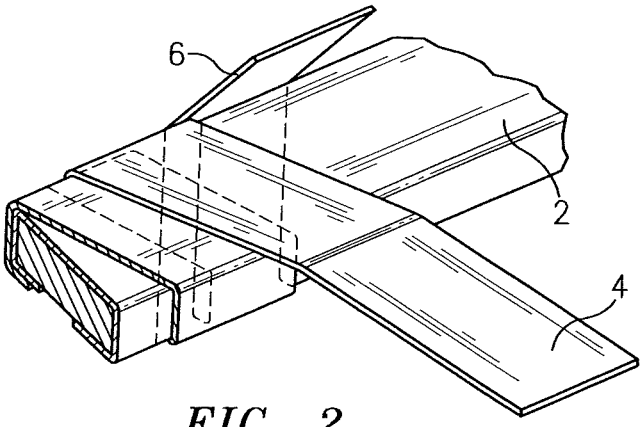
FIG. 2 is a fragmented perspective view of a spiral wrapped electrical magnet wire which is formed in accordance with this invention and which is used in the windings of an oil filled transformer.
Figure 3:
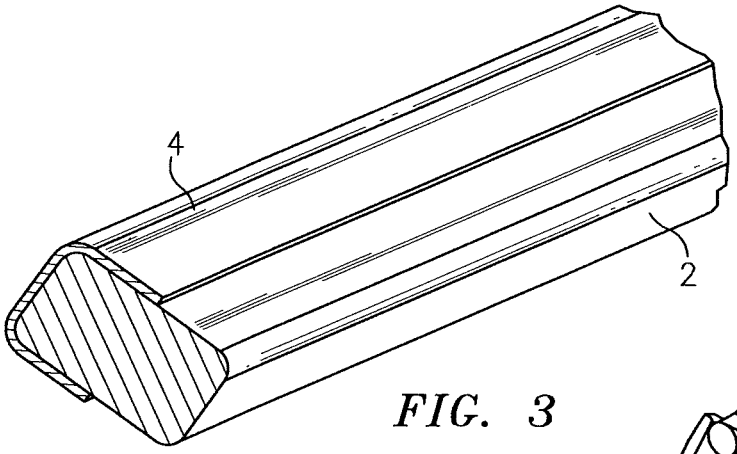
FIG. 3 is a perspective view similar to FIG. 2, but showing an electrical magnet wire having an axially insulation material which is formed in accordance with this invention and which is used in the windings of an oil filled transformer.

FIG. 1 is a fragmented diagrammatic perspective view of a transformer assembly 15. The transformer assembly 15 includes a housing 21, a core component 22, a low voltage winding coil 26, a high voltage winding coil 24, and oil 19 disposed within the housing. The coils 24, 26 are formed from magnet wire 2 encased in a cross-linked aliphatic polyamide insulation material (e.g., as shown in FIGS. 2 and 3) that will be described hereinafter. In some embodiments, the transformer assembly 15 includes insulation tubes 25 disposed between the core 22 and the low voltage winding coil 26, and between the low voltage winding coil 26 and the high voltage winding coil 24. These insulation tubes 25 may be formed from the aliphatic polyamide insulation material of this invention. Depending upon the transformer assembly configuration, the present insulation material may be disposed elsewhere within the transformer assembly 15. For example, transformer assemblies 15 may include electrically insulating material components in the form of, but not limited to, step blocks, cleats, leads, spacers, sticks, steps, pressure plates, static rings, washers, and various different molded parts. Typically, the electrically insulating material components are disposed anywhere in a transformer assembly where it is desirable to electrically separate a first element from a second element, where the first and second elements are at different electrical potentials during operation of the transformer assembly; e.g., an electrically insulating material component may be disposed to separate an electrical conductor from an element at ground, or may be disposed to separate two different electrical conductors at different electrical potentials. Electrically separating the components can prevent electrical flashover and the like. The transformer assembly 15 shown in FIG. 1 is an example of a transformer assembly, and the present invention is not limited to this particular configuration.

The present cross-linked aliphatic polyamide insulation material includes aliphatic polyamide, and/or one or more copolymers thereof, one or more cross-linkers, and stabilizing compounds. The stabilizing compounds may include one or more thermal stabilizers, or one or more chemical stabilizers, or both thermal and chemical stabilizers. The term "polyamide" describes a family of polymers which are characterized by the presence of amide groups. Many synthetic aliphatic polyamides are derived from monomers containing 6-12 carbon atoms; most prevalent are PA6 and PA66. The amide groups in the mostly semi-crystalline polyamides are capable of forming strong electrostatic forces between the —NH and the —CO— units (hydrogen bonds), producing high melting points, exceptional strength and stiffness, high barrier properties and excellent chemical resistance. Moreover, the amide units also form strong interactions with water, causing the polyamides to absorb water. These water molecules are inserted into the hydrogen bonds, loosening the intermolecular attracting forces and acting as a plasticizer, resulting in the exceptional toughness and elasticity.

The aliphatic polyamide contains at least about 65 amino end groups (i.e., 65 mmol/kg), and preferably amino end groups in the range of about 78 to 85 (i.e., 78-85 mmol/kg). The number of amino end groups in the aliphatic polyamide can be adjusted during their preparation via a suitable ratio of amino end groups to carboxylic acid end groups.

The present aliphatic polyamide insulation material further includes one or more cross-linkers comprising a carboxylic anhydride group and ethynyl moieties. For example, a carboxylic anhydride group present within a cross-linker can react with primary amino chain end groups of the aliphatic polyamide without forming any side product (e.g., water). Ethynyl moieties within the cross-linker upon heating will react with one another to form branched and cross-linked structures within the aliphatic polyamide structure. Functionalities greater than two (e.g., ethynyl moieties within MEPA) should be expected to yield large polymer structures forming infinite cross-linked networks. For most applications, the amount of cross-linker within the insulation material is in the range of about 0.1% to about 10.0% by weight. It is our finding that an insulation material having a cross-linker in the range of about 1.0% to about 3.0% works particularly well. In some embodiments, the insulation material may include one or more chain-extenders to improve reaction potential, and to control viscosity. Examples of chain-extenders that may be included in the aliphatic polyamide insulation material include epoxy, oxazoline, maleic, succinic, and/or phthalic anhydride functionalized oligomers. For those insulation material embodiments that include a chain-extender(s), the amount of chain-extender within the insulation material is typically in the range of about 0.1% to about 5.0% by weight.

Figure 8:
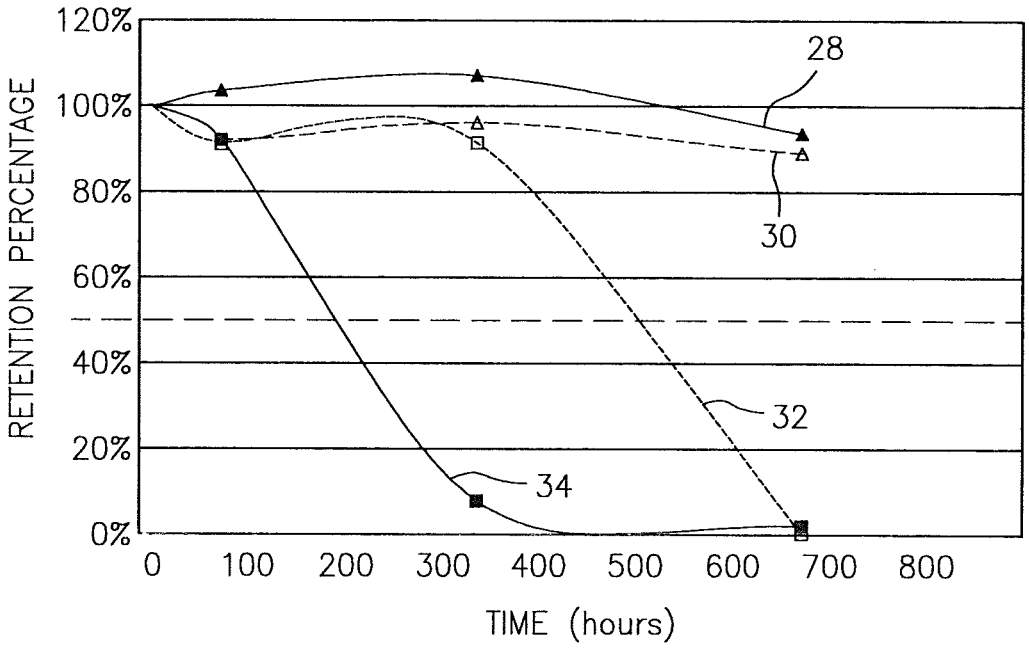
FIG. 8 is a graph of retention percent versus time in hours for four curves.

The occurrence of a gel point is one of the characteristics of the aforesaid networks formed within the aliphatic polyamide structure with the aforesaid networks. At the gel point, the aliphatic polyamide transforms from its liquid state to an elastic gel. Prior to gel point, the aliphatic polyamide is soluble in suitable solvents. Beyond the gel point, however, the aliphatic polyamide becomes insoluble. Once solidified, the chemical resistance of the cross-linked (and in some embodiments chain extended) network is significantly improved compared to the same aliphatic polyamide without the cross-linker (and chain extender). FIG. 8 is a graph showing retention percent versus time in hours for four curves: curve 28 is retention of elongation for a cross-linked aliphatic polyamide material, curve 30 is retention of yield strength for the cross-linked aliphatic polyamide material, curve 32 is retention of yield strength for an aliphatic polyamide material without cross-linking, curve 34 is retention of elongation for the aliphatic polyamide material without cross-linking. The cross-linked structure formed within aliphatic polyamide limits the diffusion of the low molecular weight acids therein. As a result, the degradation of the cross-linked aliphatic polyamide in transformer oil is inhibited.

Non-limiting examples of cross-linkers that can be used to form the present cross-linked aliphatic polyamide are commercially available from Nexam Chemical Holding AB, Scheelevägen 19, 223 63 LUND, Sweden. Nexam Chemical currently markets five different cross-linkers for different curing temperatures: NEXIMID® 100 (PEPA; e.g., Phenylethynyl phtalic anhydride), NEXIMID® 200 (EPA; e.g., ethynyl phtalic anhydride), NEXIMID®300 (PETA; e.g., 5-(3-phenylpropioloyl)isobenzofuran-1,3-dione), NEXIMID® 400 (EBPA; e.g., 5,5'-(ethyne-1,2-diyl)bis(isobenzofuran-1,3-dione), NEXIMID®500 (MEPA; e.g., 4-methylethynyl phthalic anhydride), and NEXAMITE® PBO (e.g., 1,3-phenylene-bis-oxazoline). NEXIMID® 300 (PETA) and NEXIMID®500 (MEPA) are particularly useful cross-linkers for aliphatic polyamides due to their lower reaction temperatures. NEXAMITE® PBO, which can act as an acid scavenger, can also be used to further stabilize aliphatic polyamide against acid attacks.

The process of cross-linking with the above products in polyamide resin (e.g., activating the cross linker to initiate a reaction) may be achieved using many different practical means. Non-limiting examples include: a) a non-crosslinked aliphatic polyamide film with a cross linker may be cast and in a secondary procedure be subject to heat and uniaxial or biaxial orientation; b) a non-cross linked aliphatic polyamide film with a cross linker may be spirally or linearly applied to magnet wire and in a secondary continuous procedure be subject to induction oven heating; c) a non-cross linked aliphatic polyamide resin with a cross linker may be extrusion applied to magnet wire and in a secondary continuous procedure be subject to induction oven heating; and d) a non-cross linked polyamide film with a cross linker may be spirally or linearly applied to magnet wire as it exists in a conform wire drawing process that provides significant post melt energy.

Thermal and/or chemical stabilizers that can be used within the aliphatic polyamide insulation material include one or more copper compounds and one or more salts containing a halogenide acid group. Examples of acceptable copper compounds include, but are not limited to, copper halide, copper bromide, copper iodide, and copper acetate. Examples of acceptable salts containing a halogenide acid group include, but are not limited to, calcium bromide, lithium bromide, zinc bromide, magnesium bromide, potassium bromide and potassium iodide. In some embodiments, a copper compound may include one or more complex ligands such as triphenylphosphine, mercaptobenzimidazole, EDTA, acetyl acetonate, glycine, ethylene diamine, oxalate, diethylene triamine, triethylene tetramine, pyridine, diphosphone, and dipyridyl. These copper compounds and salts provide significant thermal and chemical stability beyond the long term requirements of the current transformer designs, as will be pointed out in greater detail hereinafter. Selected mixtures of these additives may collectively be present in the present insulation material in a range of about 0.1% to about 10% by weight, and preferably about 0.5% to 0.9% by weight. In preferred embodiments, the inclusion of copper complex based antioxidants and suitable synergists within the present aliphatic polyamide insulation material results in a copper (Cu) concentration in the material of at least 150 ppm, and more preferably a copper concentration in the range of about 180 ppm to about 300 ppm.

In some embodiments, the present aliphatic polyamide insulation material may include nano-fillers. Acceptable nano-fillers that may be used within the present insulation material include, but not limited to, titanium dioxide ($TiO_2$), silicon dioxide ($SiO_2$—sometimes referred to as "fumed silica"), and aluminum oxide ($Al_2O_3$—sometimes referred to as "Alumina"). The addition of the nano-fillers to the insulation material is believed to increase the dielectric strength, improve the electrical discharge resistance, improve the thermal conductivity, provide mechanical reinforcement, improve surface erosion resistance, and increase abrasion resistance. Nano-filler particles used within the insulation material are typically in the range of about 1 nm to about 100 nm in size. The nano-filler particles are typically present in the insulation material in a range of about 0.1% to about 10.0% by weight, and preferably in the range of about 2.0% to 4.0% by weight. During formation of the insulation material, the stabilizers and the nano-fillers are preferably homogenously dispersed with the aliphatic polyamide material.

The percentage of crystallinity of the aliphatic polyamide insulation material is preferably at least 45%. Our findings are that a percentage of crystallinity in the range of about 48% to about 56% works particularly well. The relative viscosity of the aliphatic polyamide insulation material (as defined in ISO 307) prior to compounding is preferably above about 42, and more preferably in the range of about 45 to about 55. The relative viscosity of the finished insulation material is preferably not lower than pre-compounding relative viscosity, and more preferably has a relative viscosity greater than about 45.

In some embodiments, the aliphatic insulation material may include additional additives such as pigments, fillers, processing agents, nucleating agents, etc., and mixtures thereof. These additives may be helpful in the processing of the aliphatic polyamide insulating material and/or may be used for aesthetic purposes, but do not appreciable contribute to the performance of the insulating material.

Embodiments of the present aliphatic polyamide insulation material may be described as "consisting essentially of" of the aliphatic polyamide (and/or one or more copolymers thereof), the one or more cross-linkers, and the stabilizers (in the % weight ranges provided herein) since any other constituents that may be present within the insulation material do not materially affect the basic and novel characteristics of the present insulation material. Embodiments of the present aliphatic polyamide insulation material may include stabilizing compounds in a range of about 0.1 to 10.0 percent by weight, and at least one cross-linker in the range of about 0.1 to 10 percent by weight, and the remainder of the insulation material (with the possible exception of one or more additives as described herein) consists essentially of an aliphatic polyamide.

Figure 4:
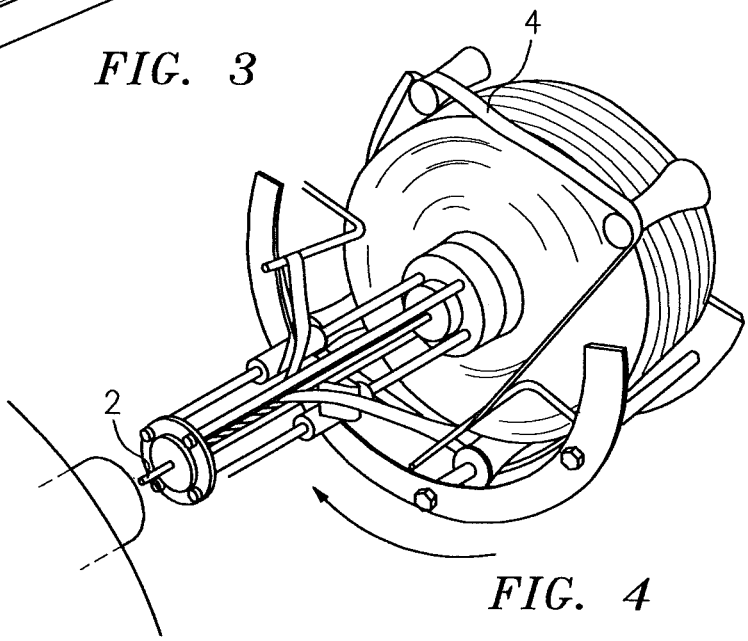
FIG. 4 illustrates a device for wrapping insulation material tape around a wire.
Figure 9:
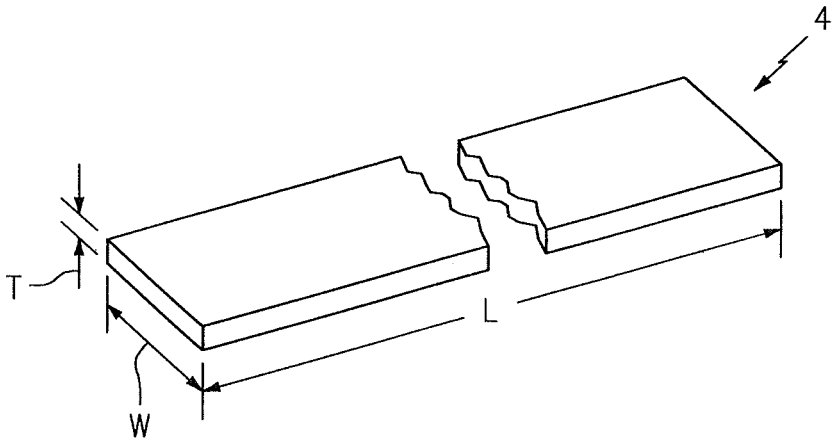
FIG. 9 is a diagrammatic view of an insulation tape embodiment.

As described above and illustrated in the FIGS. 1-3 and 9, the present insulation material can be utilized to encase the magnet wires 2 that are used within the coils 24, 26 of the transformer assembly 15. FIGS. 2 and 3 show two different forms of insulated magnet wire 2; e.g., wires 2 insulated with aliphatic polyamide insulation material in tape form; e.g., tapes 4 and 6. FIGS. 2 and 4 show insulation material tapes 4 and 6 wrapped spirally around the circumference of the wire 2. FIG. 3, in contrast, shows an insulation material tape 4 wrapped around the wire 2, in a manner where the tape is applied in an axial direction. In FIG. 3, the insulation material tape 4 is shown around only a portion of the wire 2 to illustrate the orientation of the tape 4 relative to the wire 2. The tape form of the insulation material is an example of insulation material in a film form. Referring to the diagrammatic view shown in FIG. 9, the term "tape" refers to a film embodiment wherein the length "L" of the film is substantially greater than the width "W" of the film, and the width of the film is typically substantially greater than the thickness "T" of the film. In alternative film embodiments the length and width of the film may be such that film is more sheet-like.

Figure 5:
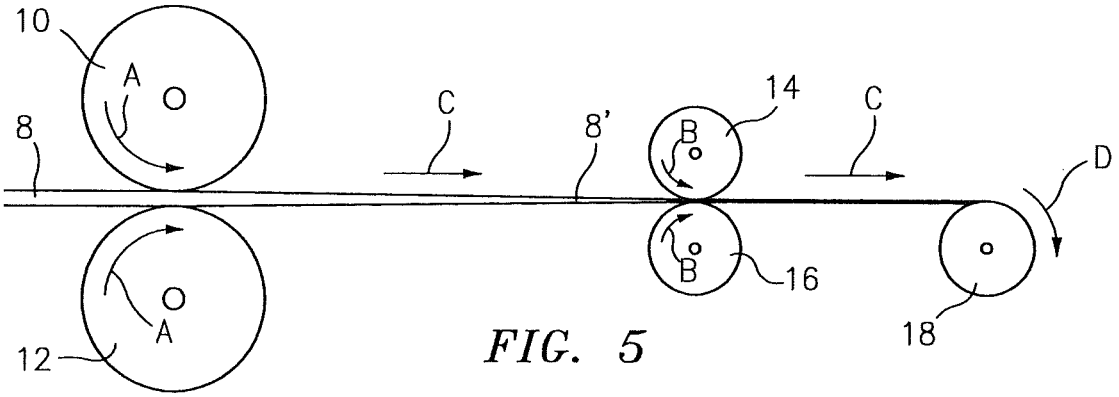
FIG. 5 is a schematic view of an assembly which is used to longitudinally stretch or elongate a film embodiment of the present aliphatic polyamide insulation material so as to induce crystallization of the film.

FIG. 5 is a schematic view of an assembly which can be used to axially elongate and stretch the insulation material when it is in the film form. The assembly includes a pair of heated rollers 10 and 12 through which the aliphatic polyamide insulation material film 8 is fed. The rollers 10 and 12 rotate in the direction A at a first predetermined speed and are operative to heat the film 8 and compress it. The heated and thinned film 8 is then fed through a second set of rollers 14 and 16 which rotate in the direction B at a second predetermined speed which is greater than the first predetermined speed, so as to stretch the film in the direction C to produce a thinner crystallized film 8 which is then fed in the direction D onto a pickup roller 8 where it is wound into a roll of the crystallized aliphatic polyamide insulation material film which can then be slit into insulation strips (i.e., tapes) if so desired.

In an alternative method, the magnet wires 2 may be coated (i.e., encased) with the insulation material by an extrusion process. The wire to be coated may be pulled at a constant rate through a crosshead die, where molten insulation material covers it.

Figure 6:
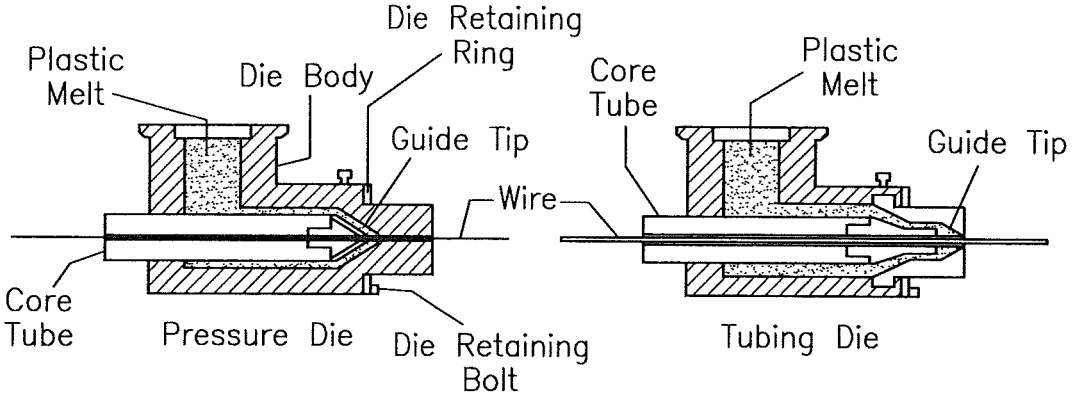
FIG. 6 is a schematic view showing the designs of a pressure die and tubing die used in wire coating operations.

FIG. 6 shows two examples of die designs that can be used in wire coating operations, although the present invention is not limited to these examples. The pressure die coats the wire inside the die, while the tubing die coats the wire core outside the die. The core tube, also referred to as the mandrel, is used to introduce the wire into the die while preventing resin from flowing backward where the wire is entering. Mandrel guide tip tolerances in a pressure die are approximately 0.001 inch (0.025 mm). This tight tolerance plus the forward wire movement prevents polymer backflow into the mandrel even at high die pressures. The guide tip is short, allowing contact of the polymer and the wire inside the die.

Figure 7:
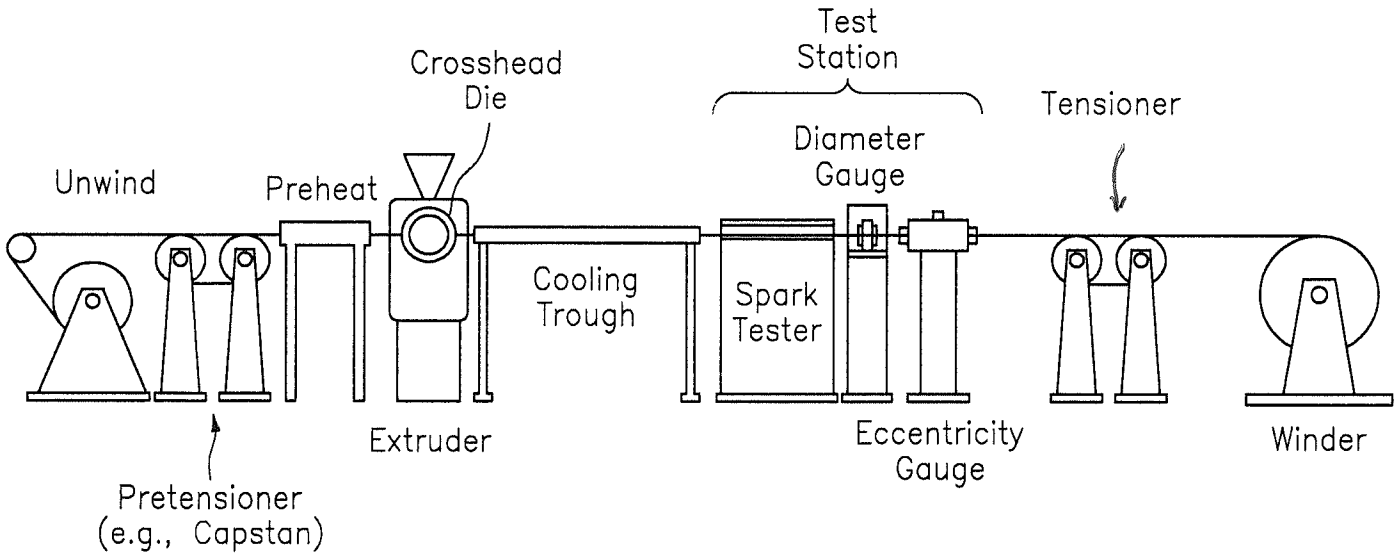
FIG. 7 is a ground view of the entire typical extrusion coating process.

FIG. 7 is a ground level view of a crosshead extrusion operation with typical equipment in the line. Typical pieces that can be used in each line include: a) an unwind station or other wire or cable source to feed the line; b) a pre-tensioning station to set the tension throughout the process; c) a preheat station to prepare the wire for coating; d) an extruder with a crosshead die; e) a cooling trough to solidify the insulation material coating; f) a test station to assure the wire is properly coated; g) a puller to provide constant tension through the process; and h) a winder to collect the wire coated with insulation material. The wire passes through a pre-heater prior to the die to bring the wire up to the temperature of the polymer used to coat the wire. Heating the wire improves the adhesion between the wire and the insulation material and expands the wire, thereby reducing any shrinkage difference that may occur between the wire and the coating during cooling. The insulation material coating will likely shrink more than the wire, because the insulation material's coefficient of thermal expansion is typically greater than that for most conductive metals. Another advantage of pre-heating the wire is to help maintain the die temperature during normal operations. Cold wire passing through a die at high speed can be a tremendous heat sink. Finally, pre-heating can be used to remove any moisture or other contaminants (such as lubricants left on the wire from a wire drawing operation) from the wire surface that might interfere with adhesion to the plastic coating. Pre-heaters are normally either gas or electrical resistance heat and are designed to heat the wire to the melt temperature of the plastic being applied to the wire or just slightly below the melt temperature.

A crosshead extrusion operation has the extruder set at a right angle to the wire reel and the rest of the downstream equipment. Wire enters the die at a 90° angle to the extruder, with the polymer entering the side of the die and exiting at a 90° angle from the extruder. The present invention is not limited to formation within a crosshead extrusion die. After exiting the die, the polymer coating may be cooled in a water trough, where the water is applied uniformly on all sides of the wire coating to prevent differences in resin shrinkage around the wire. After cooling, the wire may be passed through on-line gauges for quality control. Three different gauges are normally used to measure the wire for diameter, eccentricity, and spark. The diameter gauge measures the wire diameter. If the diameter is too large, the puller may be sped up or the extruder screw may be slowed. If the diameter is too small, the opposite of the described steps may be performed. The eccentricity gauge measures the coating uniformity around the wire. It is desirable to have uniform insulation material wall thickness around the circumference of the wire. The concentricity can be adjusted by centering the guide tip with the adjusting bolts. Finally, the spark tester checks for pinholes in the coating that can cause electrical shorts or carbon deposits in the polymer that can cause electrical conductivity through the coating. The three gauges may be installed in any order on the line. A capstan, caterpillar-type puller, or other pulling device is installed to provide constant line speed and tension during processing. A capstan is normally used with small diameter wire, where the wire is wound around a large diameter reel run at constant speed numerous times to provide a uniform pulling speed. A caterpillar-type puller with belts is used with large diameter wire. Sufficient pressure has to be applied to prevent the wire from slipping, providing uniform speed to the winder. Typically, two center winders are required in a continuous operation, with one winding up the product while the second waits in reserve for the first spool to be completed. Once the first spool is complete, the wire is transferred to the second spool as the first one is being emptied and prepared for the next.

A fibrous form of the insulating material can be formed in the following manner. The enhanced stabilized molten polymer resin is extruded through spinnerettes in a plurality of threads onto a moving support sheet whereupon the threads become entangled on the support sheet to form spun bonded sheets of the extruded material. These spun bonded sheets of insulation material are then compressed into sheets of insulation. Preferably, the sheets are then further processed by placing a plurality of them one top of one another and then they are once again passed through rollers which further compress and bond them so as to form the final sheets of the aliphatic polyamide insulating material in a fibrous form.

In order to enhance the insulation factor of the insulation of this invention, the fibrous embodiment of the insulation of this invention may be bonded to the film embodiment of the insulation of this invention to form a compound embodiment of an insulating material formed in accordance with this invention.

As indicated above, the present transformer assembly 15 may utilize the insulation material in a form other than a tape or other form (e.g., extruded coating) for covering the wires 2 within a coil 24, 26. In those embodiments where the insulation material is in a tube form or a sheet form (e.g., to insulate between coils, or between a coil and a grounded structure of the housing), the insulation material may be formed by an extrusion process and/or a roll forming process (e.g., a calendaring process). The present invention is not limited to insulation material in any particular form, or any process for making such form.

A variety of different transformer oils 19 can be used within the transformer assembly 15. For example, a mineral oil-type transformer oil (e.g., 76 Transformer Oil marketed by Conoco Lubricants), or a silicon-type transformer oil (e.g., 561 Silicone Transformer Liquid marketed by Dow Corning Corporation), or a natural ester-type transformer oil (e.g., Envirotemp FR3 marketed by Cooper Power Systems), or a high molecular weight hydrocarbon (HMWH) type transformer oil (e.g., R-Temp marketed by Cooper Power Systems). These transformer oils 19 are examples of acceptable oils, and the present invention is not limited thereto.

Although this invention has been shown and described with respect to the detailed embodiments thereof, it will be understood by those skilled in the art that various changes in form and detail may be made without departing from the spirit and scope of the invention.

What is claimed is:

1. A transformer assembly, comprising:

a housing;

a first insulation material comprising cellulose;

a plurality of coils of electrically conductive wire disposed in the housing; and an insulation material configured to electrically insulate the electrically conductive wire, the insulation material consisting essentially of an aliphatic polyamide that includes at least one cross-linker and one or more stabilizing compounds that provide thermal stability, or chemical stability, or both for the insulation material, the at least one cross-linker comprising a carboxylic anhydride group and ethynyl moieties.

2. The assembly of claim 1, wherein the at least one cross-linker is the range of about 0.1% to about 10.0% by weight of the insulation material.

3. The assembly of claim 1, wherein the aliphatic polyamide insulation material contains at least about 65 amino end groups (i.e., 65 mmol/kg).

4. The assembly of claim 1, wherein the aliphatic polyamide insulation has a copper (Cu) concentration of at least 150 ppm.

5. The assembly of claim 1, wherein the aliphatic polyamide insulation material has a percentage of crystallinity of at least about 45%.

6. The assembly of claim 1, further comprising one or more insulation tubes and a core, and the plurality of coils of electrically conductive wire includes a low voltage winding coil and a high voltage winding coil;

wherein the one or more insulation tubes comprise the cross-linked aliphatic polyamide insulation material; and wherein the one or more insulation tubes are disposed between the core and the low voltage winding coil, and between the low voltage winding coil and the high voltage winding coil.

* * * * *